US012207711B2

(12) United States Patent
Melton

(10) Patent No.: US 12,207,711 B2
(45) Date of Patent: Jan. 28, 2025

(54) CLASP

(71) Applicant: Nathan Melton, Portland, OR (US)

(72) Inventor: Nathan Melton, Portland, OR (US)

( * ) Notice: Subject to any disclaimer, the term of this patent is extended or adjusted under 35 U.S.C. 154(b) by 4 days.

(21) Appl. No.: 17/970,521

(22) Filed: Oct. 20, 2022

(65) Prior Publication Data

US 2024/0130486 A1 Apr. 25, 2024
US 2024/0225212 A9 Jul. 11, 2024

(51) Int. Cl.
*A44B 11/25* (2006.01)
*A44C 5/20* (2006.01)

(52) U.S. Cl.
CPC ..... *A44C 5/2076* (2013.01); *A44B 11/2592* (2013.01)

(58) Field of Classification Search
CPC ..... A44C 5/2076; A44B 11/2592
See application file for complete search history.

(56) References Cited

U.S. PATENT DOCUMENTS 1,807,293 A * 5/1931 Keller ..... A44C 5/2042 24/616
2,956,324 A * 10/1960 Klein ..... A44B 11/2596 24/702
3,739,433 A 6/1973 Druskin
3,844,000 A 10/1974 Hedu
4,100,657 A * 7/1978 Minolla ..... A44B 11/2511 24/642
4,150,464 A 4/1979 Tracy
4,161,806 A * 7/1979 Hennisse ..... A41F 1/006 24/594.11
4,406,043 A * 9/1983 Friedman ..... A44B 11/006 24/182
4,534,090 A 8/1985 Skobel
4,648,161 A * 3/1987 Rosen ..... A44C 5/2085 24/644
5,671,516 A * 9/1997 Sartori ..... A44B 11/2515 24/579.11
6,381,814 B1 5/2002 Colpo
6,530,133 B2 5/2003 Meyrat et al.
7,480,967 B2 * 1/2009 Kojoori ..... G04B 37/1486 2/322

(Continued)

FOREIGN PATENT DOCUMENTS

EP 002414623-0001 3/2014
EP 002414623-0002 3/2014

(Continued)

*Primary Examiner* — Jason W San
(74) *Attorney, Agent, or Firm* — P. McCoy Smith; Lex Pan Law LLC

(57) ABSTRACT

A clasp for a watch strap or belt is described, which includes one plug part and one socket part able to be joined together by inserting the plug part into the socket part with latches provided on the plug part corresponding to catches provided on the socket part so that it provides a secure connection, the plug and socket parts being able to be disconnected from each other by applying pressure to releasing protrusions provided on the plug part and the socket part that yield force necessary to overcome friction created by the latches provided on the plug part thus disconnecting the plug part from the socket part. Springs are used to bias the latches into a latched position, which bias may be overcome by applying pressure to the releasing protrusions.

18 Claims, 4 Drawing Sheets

(56) References Cited

U.S. PATENT DOCUMENTS

| | | | | |
|---|---|---|---|---|
| D630,543 | S | 1/2011 | Humphries | |
| D642,954 | S | 8/2011 | Humphries | |
| D651,936 | S | 1/2012 | Humphries | |
| D652,341 | S | 1/2012 | Humphries | |
| 8,674,835 | B2 | 3/2014 | Klein | |
| D744,886 | S | 12/2015 | Oh | |
| 9,599,133 | B2 * | 3/2017 | Gordon | F16B 2/02 |
| D811,934 | S | 3/2018 | Martinet et al. | |
| 9,930,936 | B2 * | 4/2018 | Liu | A41F 9/002 |
| 11,096,454 | B2 * | 8/2021 | Wang | A44B 11/2592 |
| 11,375,778 | B1 * | 7/2022 | Zinnbauer | A44B 11/2592 |
| 11,779,098 | B1 * | 10/2023 | Blake | A45F 5/00 224/183 |
| 2012/0000038 | A1 * | 1/2012 | Humphries | A44C 5/2085 24/303 |
| 2013/0091671 | A1 | 4/2013 | Nishida et al. | |
| 2018/0310673 | A1 * | 11/2018 | Masserini | A44B 11/2596 |
| 2020/0128924 | A1 * | 4/2020 | Yen | A44B 11/266 |
| 2024/0006795 | A1 * | 1/2024 | Cushing | H01R 13/428 |

FOREIGN PATENT DOCUMENTS

| | | | |
|---|---|---|---|
| FR | 2582200 | A1 | 11/1986 |
| FR | 3076694 | B1 | 5/2021 |
| GB | 9002414623-0001 | | 2/2014 |
| GB | 9002414623-0002 | | 2/2014 |
| WO | D075617-007 | | 7/2011 |
| WO | D075617-008 | | 7/2011 |
| WO | 2013170043 | A1 | 11/2013 |

* cited by examiner

CLASP

CROSS-REFERENCE TO RELATED APPLICATIONS

The present application is related to co-pending Design Patent Application No. 29/857,318, titled "CLASP FOR STRAP OR BELT," filed on the same date by the present inventor.

BACKGROUND OF THE INVENTION

Field of the Invention

The present invention relates to devices allowing the joining and disconnecting of two ends of a strand, such as a strap or belt. Devices connecting two ends a strand are often referred to as a clasp.

Description of Related Art

Clasps for securing two ends of strand together have been used in a variety of configurations. A common, and quite old, clasp that has been used with belts, securing straps, and watchbands for hundreds of years includes a series of pierced holes in one end of the strap, and a frame-and-prong buckle at the other end, where the pierced end is fed through the frame on the other end, and the prong is inserted through one of the pierced holes to secure one end of the strap to the other end.

Another known type of clasp is one that folds and is secured using a friction snap. These clasps are more difficult to manufacture as they require an increased number of parts and must be assembled. The snap runs the risk of becoming ineffective over time due to wear especially when made from non-metal materials. The geometric arrangement of the folding parts also present risk of breakage if force is applied in an asymmetrical direction while the clasp is in the open position.

Clasps that require full insertion and encasement of a plug end into a socket end can be practical but only in limited applications when two hands can be used to assemble the clasp such as a waist belt. This type of clasp typically includes multiple interlocking plug and socket components that prove difficult to align if used in other applications such as watch strap. In the case of a watch strap the user has only one free hand to manipulate the clasp and would find it difficult to properly align and connect each part.

An example of a clasp that includes latches may be found in U.S. Pat. No. 4,150,464. A disadvantage of this design is that the latches must both be inserted inside the socket component in order to fully engage, thus making engagement and disengagement of the latches more difficult and also allowing for difficulty in aligning the plug and socket parts into a position to allow easier engagement of the latches with their respective catches.

BRIEF SUMMARY OF THE INVENTION

The objective of the present invention is to produce a clasp that is easy to engage and disengage, can be manufactured using 3D printing, injection molding, laser cutting, or milling, can be utilized in multiple applications such as belts, watch straps, or cargo straps, and can demonstrate all of the elements of a quality strap in numerous applications.

The present invention is a clasp that can be used to secure two ends of a strand such as a belt, watch strap, or cargo strap. The clasp is made of one plug part and one socket part and is joined by inserting the plug part into the socket part. As used herein, "plug" and "socket" are used as a non-gendered alternative to the concept of "male" and "female" connector portions, wherein a "plug" has some form of protrusion that fits snugly into a receptacle in the "socket". A secure connection is established due to the fact that forces exerted on the strap when connected and in use are naturally applied perpendicularly to the direction of motion in which the strap is connected. Two latching mechanisms also support a secure connection by continually applying friction while in the connected position.

To connect the clasp the user will align the plug part and socket part on an equal plane, such that the cantilevered arm of the plug part is generally aligned with the socket component of the socket part. The user will then press the plug part towards the socket part until the latching mechanisms on the plug part engage with corresponding catches on the socket part. To open the clasp the user will press against two opposing releasing protrusions which when pressed will apply force in the opposite direction as required to close the clasp. When opening the clasp, the user need only apply enough force to overcome the friction generated by the latching mechanisms.

A beneficial feature of the present invention is that the cantilevered arm of the plug part and the socket component of the socket part are tapered and shaped in equal and opposite profiles which allow for ease of alignment of each part as they are connected. Tapered profiles also existing between the latching mechanisms on the plug part and the corresponding catches on the socket part and each also aid in the alignment process.

Additional beneficial elements of the present invention include two springs in the plug part which are not made from separate components, nor do they require any separate assembly, but which are incorporated as a part of the whole of the plug part. These springs are connected to and provide force against the latching mechanisms and function by flexing thin elements connected to the plug part within their elastic limit as the clasp is being connected.

When the user begins to connect the plug part with the socket part tapered surfaces between the cantilevered arm of the plug part and the socket component of the socket part align and the arm naturally begins to insert itself into the socket. At the same moment surfaces on the socket part begin to press against latching mechanisms connected to springs on the plug part. The springs are fully compressed as the arm is inserted. Once the arm is fully inserted into the socket, latches on the plug part engage with catches on the socket part. The catches function by allowing for decompression of the springs on the plug part. This decompression of the springs allows for continuous force to be applied against the catches on the socket part and thus securely holds the clasp in the connected position.

The springs on the plug part are incorporated as a part of the whole of the part which reduce the total number of parts required to produce the clasp. Both the plug part and socket part are each comprised of a single manufactured item for a total of two items which make up the complete clasp. Both the plug part and the socket part are fully functional immediately after manufacturing with no assembling or adjusting required. As the present invention does not require the plug part to be fully inserted and encased in the socket part it is naturally more compact and allows for easier connection of each part in many use applications.

The plug part and the socket part are manufactured using moldable or malleable materials which when shaped in geometries with sufficient thicknesses exhibit relatively rigid behavior and also when shaped in geometries with thin profiles exhibit resilient deformation, or flexible spring-like behavior. These material characteristics allow for the creation of individual parts that demonstrate both rigidity and flexibility. Materials which demonstrate these behaviors include polylactic acid (common material used in 3d printing), polyethylene (commonly used in injection molding), and malleable metals such as stainless steel, brass, or bonze (commonly used in milling or CNC forming). Any material demonstrating similar characteristics as previously mentioned can be utilized in the manufacture of the present invention.

DETAILED DESCRIPTION OF THE INVENTION

Figure 1:
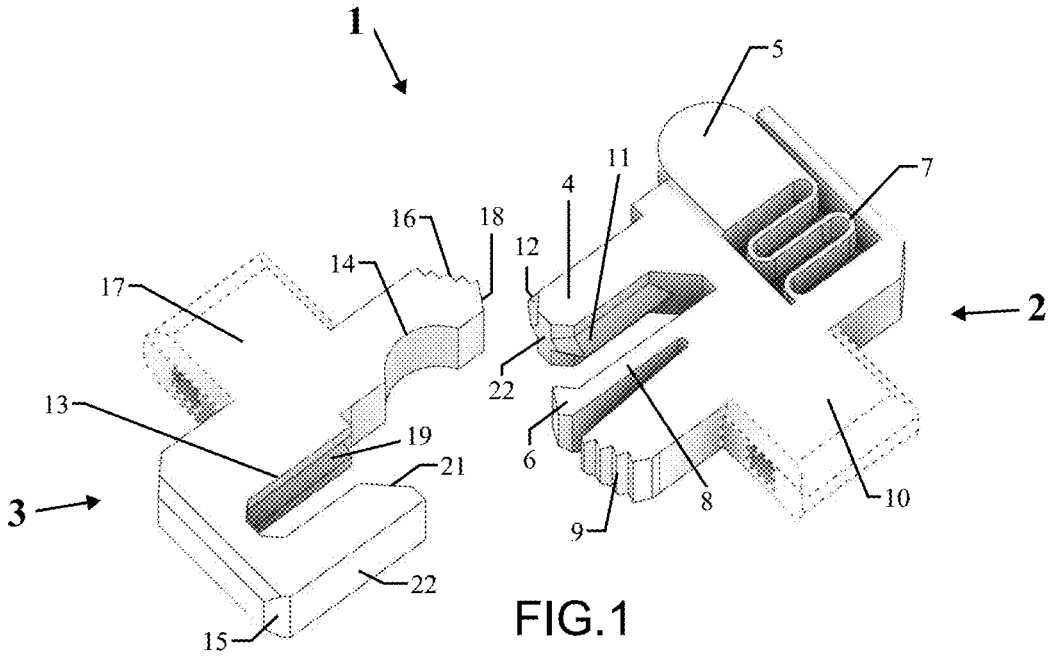
FIG. 1 is a perspective view of the plug and socket parts which together form the clasp.
Figure 2:
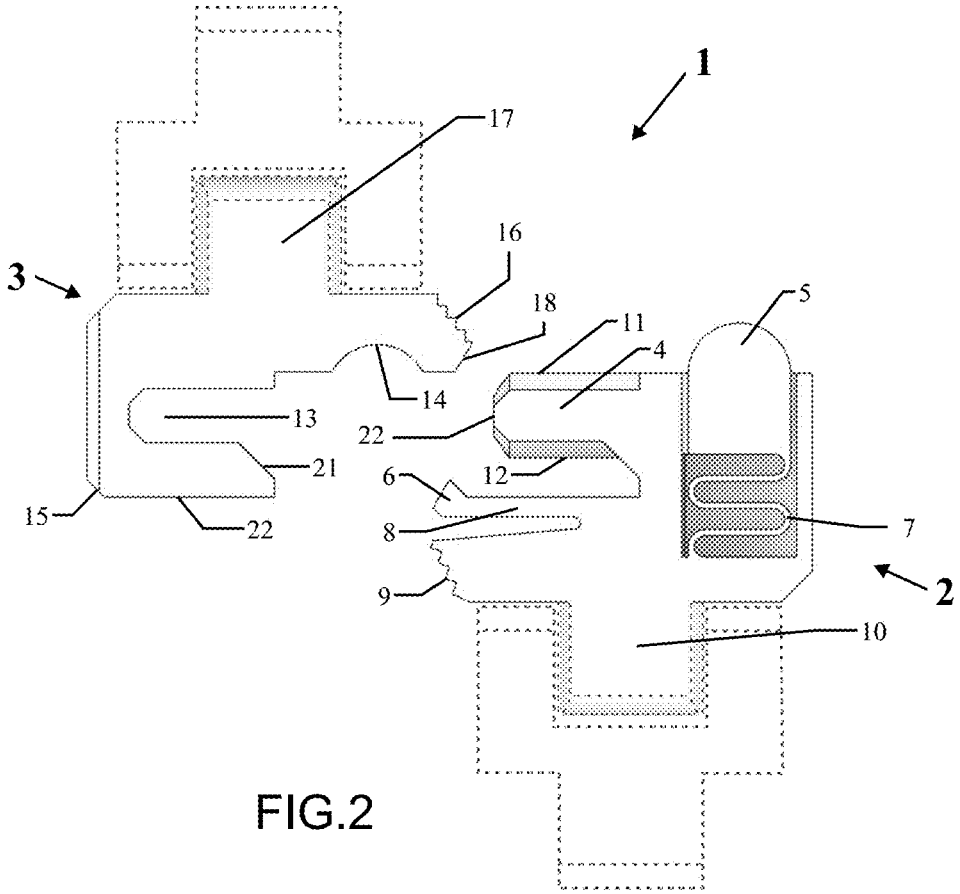
FIG. 2 shows a plan view of the clasp in the open position.
Figure 3:
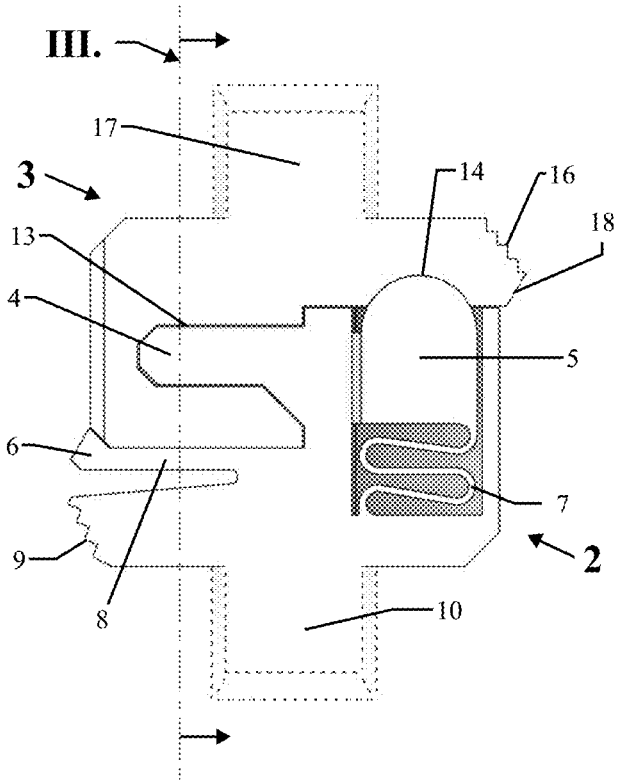
FIG. 3 shows a plan view of the clasp in the closed position.
Figure 4:
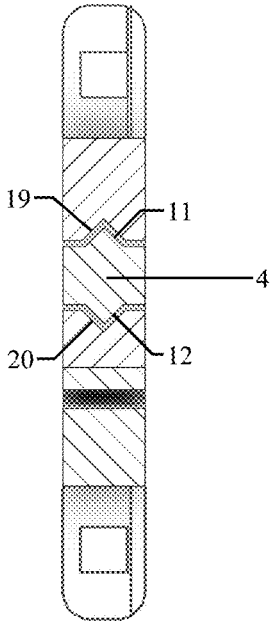
FIG. 4 shows a cross section of the connected clasp along line III, as identified in FIG. 3.

As shown in FIGS. 1 and 2 is a clasp representing the present invention generally identified and designated as a whole by numeral 1, made up of a plug part 2 and a socket part 3 and is connected by inserting the plug part 2 into the socket part 3. FIGS. 3 and 4 show a cross section along E, through both the plug part 2 and the socket part 3 when in the connected position. Both the plug part 2 and the socket part 3 can be made from metal, plastic, wood or any other type of material that is relatively rigid in sufficient thickness, but with resilient elastic properties, if sufficiently thin. Example strands in the form of links are shown for context with dotted lines in FIG. 2 but are not a part of the clasp.

As identified in FIGS. 1 through 4, the plug part 2 has an overall generally rectangular shape inclusive of a protruding cantilevered arm 4, a semicircular latch 5, a triangular latch 6, a sinuous spring 7, a flat spring 8, a releasing protrusion 9, and a strand connector 10. The cantilevered arm 4 is generally rectangular in shape when viewed in cross section, as in FIG. 4, except for triangular alignment guides 11 and 12 arranged symmetrically along the longitudinal sides. The cantilevered arm 4 is also solid in cross section, such that the cantilevered arm 4 is relatively rigid so as to reduce the chance of breakage and to provide a more substantial foundation for the insertion of the cantilevered arm 4 into the socket component 13. The alignment guides 11 and 12 are tapered and shaped in equal and opposite dimensions as triangular grooves 19 and 20 in the socket component 13 of the socket part 3, to allow for ease of alignment when connecting the plug part 2 with the socket part 3. The semicircular shape of latch 5 is beneficial in that it automatically compresses sinuous spring 7 as the plug part is inserted into socket part 3. Similar tapering in latch 6 creates a bending motion in spring 8 as the bottom of the socket part 22 presses against latch 6 during clasp 1 assembly. As will be discussed further below, the pressure applied to springs 7 and 8 yield beneficial friction that provides for a reliable connection between the plug part 2 and socket part 3 when connected. The releasing protrusion 9 includes a ribbed surface for grip, allowing the user to more easily apply pressure against spring 8 to disconnect the clasp.

The strand connector 10 can include a socket where a pin may be inserted (not shown) for facilitating the connection of a link, or looped piece of fabric or rope. The present invention is not limited by the current shape of the strand connector 10 as shown in the referenced drawings and can be modified in numerous ways to allow for the connection various types of strands, whether made of interlocking links, or flexible materials such as rope or fabric.

The socket part 3 as identified in FIGS. 1 through 4 is also generally rectangular in shape and includes a socket component 13, a semicircular catch 14, a tapered catch 15, a releasing protrusion 16, and a strand connector 17. The socket component 13 has a tapered entry 21 which aids in guiding the cantilevered arm 4, which also has tapering on its distal end 22, thereby facilitating the smooth entry of the cantilevered arm 4 into the socketed component 13. The socketed component 13 is shaped in equal and opposite dimensions as the cantilevered arm 4 of the plug part 2 and acts as a cavity to receive the cantilevered arm 4 as the clasp is connected. The socket component 13 includes triangular grooves 19 and 20 which are shaped in equal and opposite dimensions as alignment guides 11 and 12 and aid in of alignment when connecting the plug part 2 with the socket part 3. Other than the socket component 13, the socket part 3 is solid in cross-section, thus making the socket part 3 less subject to fatigue and breaking after multiple engagements and disengagements of the clasp 1. The semicircular catch 14 includes a tapered leading edge 18 which applies pressure against the semicircular latch 5 as the clasp is connected, thereby depressing the sinuous spring 7 downwardly. The bottom side of the socket part 3, as well the tapered catch 15, apply similar pressure to latch 6 as the clasp is connected. Releasing protrusion 16 of the socket part 3, similar to releasing protrusion 9, includes a ribbed surface for grip whereby the user will apply pressure to disconnect the clasp. In the preferred embodiment, the releasing protrusions 9 and 16 include an angled surface at 45 degrees from the direction of movement of the latches 5 and 6 from their engagement and disengagement directions, thereby providing advantageous leverage against the springs 7 and 8. One advantage of the use of a triangular latch 6, flat spring 8 and tapered catch 15 is that the latch 6 rides on the outside of the plug part 2 and thus does not require an internal alignment to engage and catch. Also similar to strand connector 10, strand connector 17 of the socket part 3 includes a socket where a pin may be inserted to facilitate the connection of a link, or a piece of fabric or rope. This strand connector is also not limited by the current shape as displayed in the referenced drawings and can be modified as previously explained with regard to strand connector 10.

Springs 7 and 8 that exist as a part of the plug part 3 function by allowing for resilient deformation created due to pressure applied by the socket part 4 as explained in the previous paragraph. This resilient deformation creates pressure between the latches 5 and 6 of the plug part 2 and the catches 14 and 15 of the socket part 3, thereby locking the clasp 1 in the closed position when connected. Once the clasp 1 is fully connected spring 8 becomes decompressed and returns to its unbiased original position which locks latch 6 of the plug part 2 against catch 15 of the socket part 3. Similarly catch 14 allows for partial decompression of spring 7 to a partially unbiased position and locks latch 5 against catch 14.

Figure 5:
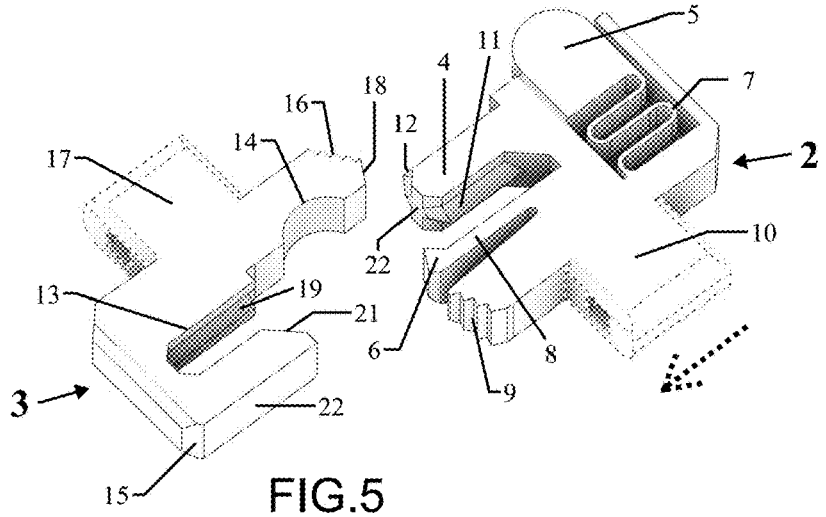
FIG. 5 shows the starting position for connecting the clasp and the motion of the plug part required for connection identified by the bold arrow.
Figure 6:
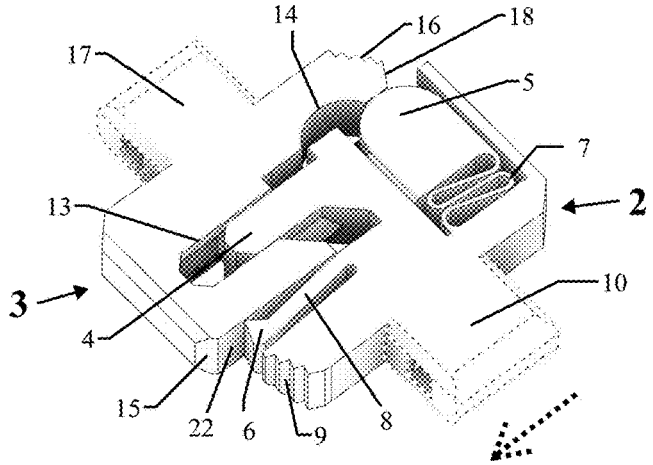
FIG. 6 shows a midpoint position in connecting the clasp with the motion of the plug part identified by the bold arrow.
Figure 7:
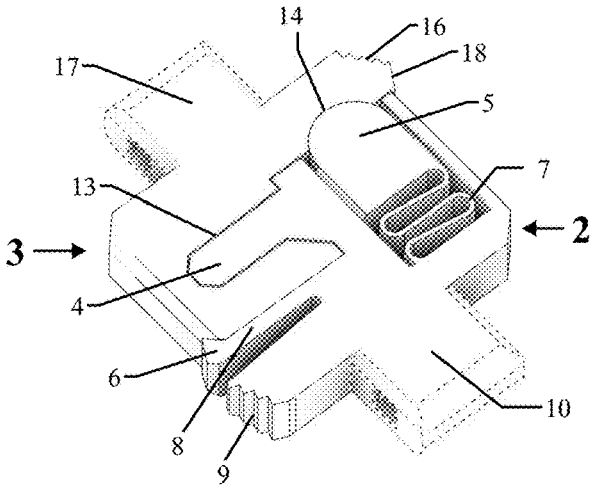
FIG. 7 shows the clasp in the final position after completing the work of connecting the clasp.

To connect the clasp the user will first place the plug part 2 and the socket part 3 on an equal plane as shown in FIG. 5. The cantilevered arm 4 of the plug part 2 should be generally aligned with the socketed component 13 of the socket part 3. The user will then move the plug part 2 towards the socket part 3 in the direction indicated by the bold arrow in FIG. 5. As shown in FIG. 6. once the plug part comes into contact with the socket part 3 the cantilevered arm 4 naturally inserts itself into the socketed component 13 through aid from alignment guides 11 and 12 and grooves 19 and 20. At this point the socket part 3, specifically the tapered surface 18 and the bottom surface 22, applies pressure against latches 5 and 6, thereby compressing springs 7 and 8. The user will continue to move the plug part 2 towards the socket part 3 as identified by the bold arrow in FIG. 6. until the cantilevered arm 4 is fully inserted into the socket component 13. In FIG. 7 the cantilevered arm 4 is fully inserted, springs 7 and 8 are decompressed (spring 7 is partially decompressed; spring 8 is fully decompressed) and catches 5 and 6 are locked in place via friction applied to catches 14 and 15.

Figure 8:
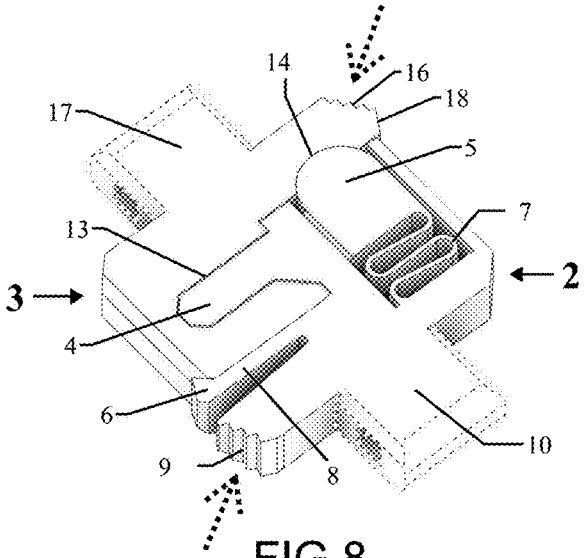
FIG. 8 shows the starting position for disconnecting the clasp and the direction of force required to disconnect the clasp indicated by the bold arrows.
Figure 9:
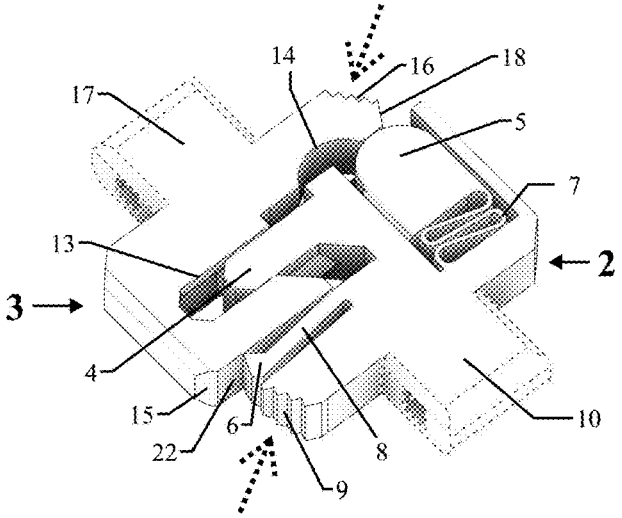
FIG. 9 shows a midpoint position in disconnecting the clasp with the direction of continued force required to disconnect the clasp indicated by the bold arrows.

To disconnect the clasp the user will begin with the connected parts as shown in FIG. 8 and will apply pressure to releasing protrusions 9 and 16, in the direction indicated by the bold arrows. The pressure applied to the releasing protrusions 9 and 16 is translated through the structure of the plug and socket parts 2 and 3 and results in equal pressure being applied to the lateral surface of latch 5 and the medial surface of latch 6. The user will increase the pressure applied to the releasing protrusions 9 and 16 until the translated force applied to the latches 5 and 6 is such that the springs 7 and 8 begin to compress due to the tapered surfaces of catches 14 and 15. FIG. 9 shows the springs 7 and 8 in a compressed state as the user continues to apply force to the releasing protrusions 9 and 16.

Figure 10:
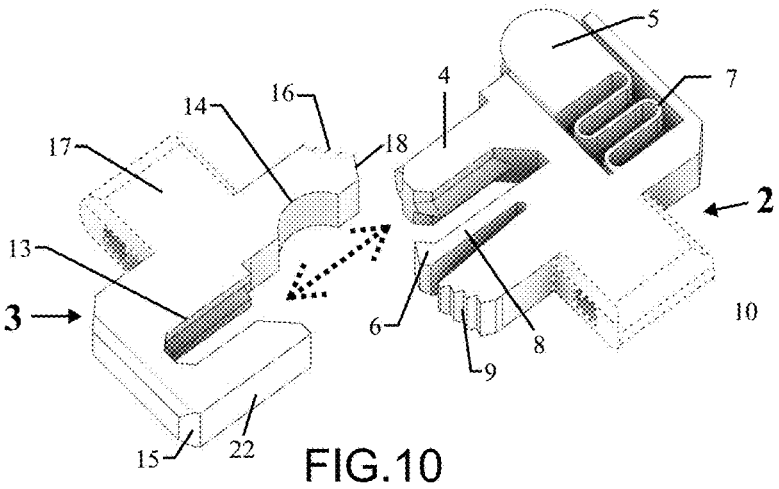
FIG. 10 shows the clasp in the final position after completing the work of disconnecting the clasp.

Once the plug and socket parts 1 and 2 are separated sufficient that latch 5 comes into contact with tapered surface 18, spring 7 will fully decompress. At this point the remaining work of disconnecting the clasp will happen automatically. The sudden release of pressure in spring 7 applied through catch 5 against tapered surface 18 will overcome any remaining friction between the plug 2 and socket parts 3 and each will spring apart in an expeditious manner per the bold double ended arrow in FIG. 10.

Alternative embodiments are contemplated within the overall scope and spirit of the present invention. For example, rather than having different latching mechanisms as shown in FIGS. 1-10, the latching mechanisms could be mirrored on opposite sides of the clasp, such that there are two tapering latches 6, flat springs 8, releasing protrusions 9, and tapered catches 15 on opposite sides of the plug 2 and socket 3 parts, configured as mirror images of one another. Similarly, the latching mechanisms could also be mirrored so that there are two semicircular latches 5, sinuous springs 7, and semicircular catch 14 on opposite sides of the plug 2 and socket 3 parts.

The foregoing description with attached drawings is only illustrative of possible embodiments of the described clasp, and should only be construed as such. Many other specific embodiments are possible that fall within the scope and spirit of the present invention. The scope of the invention is indicated by the following claims rather than the foregoing description. Any and all modifications which come within the meaning and range of equivalents of the following claims are to be considered within their scope.

The invention claimed is:

1. A clasp for connecting two strands, comprising:

a plug part, the plug part including at least one latch, the at least one latch being biased by at least one spring; and a socket part, the socket part including at least one catch, the at least one catch configured to releasably connect the plug part to the socket part by engaging and disengaging the at least one latch, the socket part including an outer surface;

wherein the at least one latch moves along the outer surface of the socket part during engagement with the at least one catch against the bias of the at least one spring;

wherein the plug part includes a semicircular latch and a triangular latch, and the socket part includes a semicircular catch configured to engage the semicircular latch and a tapered catch configured to engage the triangular latch.

2. A clasp according to claim 1, wherein the plug and socket parts are made of a material with resilient elastic properties.

3. A clasp according to claim 1, wherein the plug socket parts are manufactured using 3D printing.

4. A clasp according to claim 1, wherein the plug and socket parts each include a strand connector.

5. A clasp according to claim 2, wherein the plug part includes a sinuous spring connected to the semicircular latch, and a flat spring connected to the triangular latch, and wherein both the sinuous spring and the flat spring are manufactured integral to, and in one piece, with the plug part.

6. A clasp according to claim 5, wherein surfaces of the socket part allow for resilient compression of the springs connected to latches on the plug part, when the plug part is inserted into the socket part, and wherein the catches provided on the socket part allow for decompression of the springs when the plug part is fully inserted into the socket part, thereby locking the latches against the catches.

7. A clasp according to claim 1, wherein the plug part includes at least one releasing protrusion connected to the at least one latch, and wherein the plug part is disconnected from the socket part by applying force to the at least one releasing protrusion, thereby disengaging the at least one latch from the at least one catch.

8. The clasp according to claim 7, wherein the at least one releasing protrusion includes a surface at an angle to the direction of movement of the at least one latch, thereby providing leverage for engaging and disengaging the at least one latch.

9. The clasp according to claim 1, wherein the plug part includes at least one protruding arm, and wherein the socket part has at least one socket component configured to snugly receive the at least one protruding arm.

10. A clasp for connecting two strands, comprising:

a plug part, the plug part including at least one latch, the at least one latch being biased by at least one spring; and a socket part, the socket part including at least one catch, the at least one catch configured to releasably connect the plug part to the socket part by engaging and disengaging the at least one latch, the socket part including an outer surface;

wherein the at least one latch moves along the outer surface of the socket part during engagement with the at least one catch against the bias of the at least one spring;

wherein the plug part includes at least one protruding arm, and wherein the socket part has at least one socket component configured to snugly receive the at least one protruding arm; and wherein the at least one protruding arm includes at least one angular alignment guide, and wherein the at least one socket component includes at least one angular groove, the at least one angular groove receiving the at least one angular alignment guide.

11. The clasp according to claim 10, wherein the at least one protruding arm is solid in cross-section.

12. The clasp according to claim 10, wherein the socket part, other than the at least one socket component, is solid in cross-section.

13. A clasp for connecting two strands, comprising:

a plug part, the plug part including a semicircular latch and a triangular latch, the latches each being biased by at least one spring; and a socket part, the socket part including a semicircular catch configured to engage the semicircular latch and a tapered catch configured to engage the triangular latch, the catches configured to releasably connect the plug part to the socket part by engaging and disengaging the latches;

wherein the plug part includes a sinuous spring connected to the semicircular latch, and a flat spring connected to the triangular latch, and wherein both the sinuous spring and the flat spring are manufactured integral to, and in one piece, with the plug part.

14. A clasp according to claim 13, wherein surfaces of the socket part allow for resilient compression of the springs connected to the latches on the plug part, when the plug part is inserted into the socket part, and wherein the catches provided on the socket part allow for decompression of the springs when the plug part is fully inserted into the socket part, thereby locking the latches against the catches.

15. A clasp according to claim 13, wherein the plug part includes at least one releasing protrusion connected to each latch, and wherein the plug part is disconnected from the socket part by applying force to the releasing protrusions, thereby disengaging the latches from the catches.

16. The clasp according to claim 15, wherein the releasing protrusions include a surface at an angle to the direction of movement of the latches, thereby providing leverage for engaging and disengaging the latches.

17. The clasp according to claim 13, wherein the plug part includes at least one protruding arm, and wherein the socket part has at least one socket component configured to snugly receive the at least one protruding arm.

18. A clasp for connecting two strands, comprising:

a plug part, the plug part including a semicircular latch and a triangular latch, the latches each being biased by at least one spring, wherein a sinuous spring is connected to the semicircular latch, and wherein a flat spring is connected to the triangular latch, and wherein both the sinuous spring and the flat spring are manufactured integral to, and in one piece, with the plug part, wherein the plug part includes at least one releasing protrusion connected to each latch, and wherein the plug part is disconnected from the socket part by applying force to the releasing protrusions, thereby disengaging the latches from the catches, wherein the releasing protrusions include a surface at an angle to the direction of movement of the latches, thereby providing leverage for engaging and disengaging the latches; and a socket part, the socket part including a semicircular catch configured to engage the semicircular latch and a tapered catch configured to engage the triangular latch, the catches configured to releasably connect the plug part to the socket part by engaging and disengaging the latches, and wherein surfaces of the socket part allow for resilient compression of the springs connected to the latches on the plug part, when the plug part is inserted into the socket part, and wherein the catches provided on the socket part allow for decompression of the springs when the plug part is fully inserted into the socket part, thereby locking the latches against the catches, and wherein the plug part includes at least one protruding arm, and the socket part has at least one socket component configured to snugly receive the at least one protruding arm.

* * * * *